US008375491B2

(12) United States Patent
Hinderliter, II

(10) Patent No.: US 8,375,491 B2
(45) Date of Patent: Feb. 19, 2013

(54) INFANT LAP SUPPORT

(76) Inventor: Don E. Hinderliter, II, Richardson, TX (US)

( * ) Notice: Subject to any disclaimer, the term of this patent is extended or adjusted under 35 U.S.C. 154(b) by 2 days.

(21) Appl. No.: 12/651,218

(22) Filed: Dec. 31, 2009

(65) Prior Publication Data

US 2011/0154573 A1 Jun. 30, 2011

(51) Int. Cl.
*B68G 5/00* (2006.01)

(52) U.S. Cl. ..... 5/655; 5/420; 108/43

(58) Field of Classification Search ..... 5/655, 420; 297/153; 108/43
See application file for complete search history.

(56) References Cited

U.S. PATENT DOCUMENTS

| | | | | |
|---|---|---|---|---|
| 2,502,752 | A | 4/1950 | Richards | |
| 5,159,727 | A | 11/1992 | McCracken | |
| 5,551,109 | A | 9/1996 | Tingley | |
| 5,581,833 | A | 12/1996 | Zenoff | |
| 5,664,828 | A | 9/1997 | Simon | |
| 5,862,933 | A * | 1/1999 | Neville | 108/43 |
| 6,061,854 | A | 5/2000 | Crowley | |
| 6,116,165 | A * | 9/2000 | Kadesky | 108/43 |
| 6,189,169 | B1 | 2/2001 | Marcotte | |
| RE37,239 | E * | 6/2001 | Eisenberg | 108/43 |
| 6,564,408 | B2 | 5/2003 | Van Vuuren | |
| 6,663,072 | B1 * | 12/2003 | Ritchey et al. | 248/444 |
| 6,754,924 | B1 | 6/2004 | Brady | |
| 7,107,639 | B2 | 9/2006 | Taricani | |
| 2003/0071184 | A1 * | 4/2003 | Parkinson | 248/346.01 |
| 2007/0089646 | A1 * | 4/2007 | Duncan | 108/43 |
| 2010/0133268 | A1 * | 6/2010 | Miller | 108/43 |

OTHER PUBLICATIONS

Healing Enhancements 12" Abdominal Binder, http://www.healingenhancements.com/compressionbinder12.aspx.
AMAZON.COM Simmons Kids Contour Dressing Table Pad, http://www.amazon.com/Simmons-Contour-Dressing-Non-Skid-Bottom/dp/B000JIHHAO.
Recovery Elements 12" abdominal binder by Marena http://recoveryelements.com/ab412abdominalbinder.aspx.

* cited by examiner

*Primary Examiner* — Robert G Santos
*Assistant Examiner* — Brittany Wilson
(74) *Attorney, Agent, or Firm* — George M. Tompkins; Tompkins, P.C.

(57) ABSTRACT

Disclosed is an infant lap support comprising an infant support panel having a first edge and a second edge, a leg attachment member having two or more attachment points, wherein a first attachment point is attached to the first edge of the infant support panel and wherein a second attachment point is attached to a first fastener, and a second fastener attached to a second edge of the infant support panel, wherein the first fastener and the second fastener are configured to be selectively fastened to each other around the legs of a user.

20 Claims, 8 Drawing Sheets

INFANT LAP SUPPORT

TECHNICAL FIELD OF THE INVENTION

The present invention is generally directed towards a device to aid in the securing of an infant child in a user's lap.

BACKGROUND ART OF THE INVENTION

It is common for parents, caregivers, relatives and others (collectively referred to herein as "caregivers") to hold an infant child in the caregiver's lap or on the caregiver's legs or knees while in a seated position. Holding an infant in this manner allows the caregiver and the infant to interact and to see each other's faces. The position also allows the caregiver to use their arms for other activities while holding the infant.

Prior to the present invention, the caregiver typically resorted to placing the infant on the caregiver's legs. This necessitates the caregiver holding his or her legs together to prevent the infant from slipping between them. This can become uncomfortable for the caregiver over an extended period of time, and may result in the infant slipping if the caregiver is not careful. Additionally, the caregiver may be wearing clothing that is not soft, such as denim, which may be uncomfortable for the infant.

The invention disclosed herein overcomes the limitations of the prior art by providing a soft support surface for the infant to lay on, and one or more leg engaging members to secure the caregiver's legs and prevent the infant from slipping between the caregivers legs.

SUMMARY OF THE INVENTION

Disclosed herein is an infant lap support comprising an infant support panel having a first edge and a second edge, a leg attachment member having two or more attachment points, wherein a first attachment point is attached to the first edge of the infant support panel and wherein a second attachment point is attached to a first fastener, and a second fastener attached to a second edge of the infant support panel, wherein the first fastener and the second fastener are configured to be selectively fastened to each other.

In a further embodiment, the infant support panel is generally rectangular.

In a further embodiment, the first edge and the second edge of the infant support panel are opposite of each other.

In a further embodiment, the infant support panel is constructed from a soft and elastic fabric.

In a further embodiment, the leg attachment member is attached to the infant support panel by two or more connecting members, which connecting members attach to the first edge of the infant support panel at two or more locations.

In a further embodiment, the infant support panel comprises a first layer and a second layer, wherein the connecting members extend across a portion of the infant support panel between the first layer and the second layer.

In a further embodiment, the first and second layer of the infant support panel and the connecting members are sewn together.

In a further embodiment, the infant support panel comprises two or more reinforcing members configured to provide vertical rigidity to the infant support panel, wherein a first reinforcing member is located along or near the first edge of the infant support panel and a second reinforcing member is located along or near the second edge of the infant support panel.

In a further embodiment, the infant support panel comprises an infant restraint configured to hinder an infant from moving off of the infant support panel.

In a further embodiment, the leg attachment member has a length which is adjustable by a user.

In an additional embodiment, the infant lap support comprises an infant support panel, wherein the infant support panel comprises first and second vertical edges which are generally straight and which are horizontally opposed, a first reinforcing member attached to the first vertical edge, a second reinforcing member attached to the second vertical edge, a first leg attachment member with two attachment points, wherein the first attachment point is attached to the first reinforcing member and the second attachment point is attached to a first fastener, a second leg attachment member with two attachment points, wherein the first attachment point is attached to the second reinforcing member and the second attachment point is attached to a second fastener; and wherein the first and second fasteners are configured to be selectively connected by a user around legs of the user.

In another embodiment, an infant lap support comprises an infant support panel, the infant support panel comprising an edge and first and second opposing faces, the first face of the infant support panel being configured to support an infant and the second face of the infant support panel comprising at least a portion of a hook and loop fastener, a leg engagement panel comprising first and second edges, wherein the first edge is attached to the edge of the infant support panel, a fastening panel comprising an edge, the fastening panel being attached at the edge to the second edge of the leg engagement panel, wherein the fastening panel further comprises a portion of a hook and loop fastener, and wherein the portion of hook and loop fastener on the fastening panel is configured to selectively engage the portion of hook and loop fastener on the infant support panel when the infant lap support is connected around legs of a user.

BRIEF DESCRIPTION OF THE DRAWINGS

Applicant's invention may be further understood from a description of the accompanying drawings, wherein, unless otherwise specified, like referenced numerals are intended to depict like components in the various views.

DETAILED DESCRIPTION OF THE PREFERRED EMBODIMENT

Figure 1:
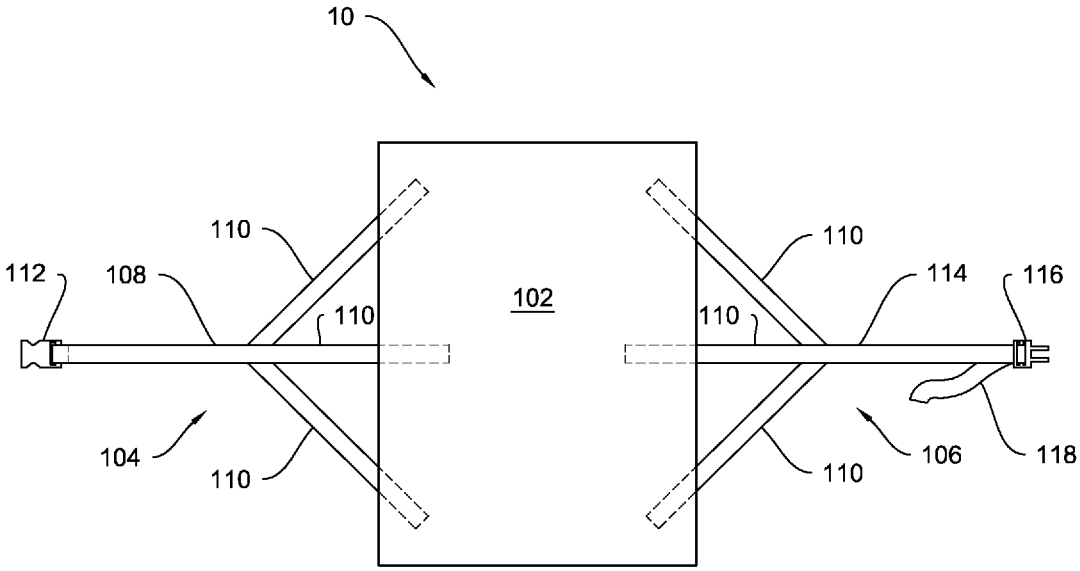
FIG. 1 is a view of an infant lap support show spread out and not connected to a user.

Referring to FIG. 1, an infant lap support 10 is shown. For purposes of ease in understanding, the portion of infant lap support 10 as shown in FIG. 1 (and other infant lap support devices disclosed below) nearest the top of the page shall be referred to as the "top" of infant lap support 10. Likewise, the portion of infant lap support 10 as shown in FIG. 1 nearest the bottom of the page shall be referred to as the "bottom" of infant lap support 10. Lines from top to bottom or vice versa shall be called longitudinal or vertical and lines perpendicular thereto shall be referred to as lateral or horizontal.

Infant lap support 10 generally comprises an infant support panel 102, a left-side leg attachment member 104, and a right-side leg attachment member 106. Left-side leg attachment member 104 preferably comprises a left-side under leg strap 108 which is preferably connected by a plurality of connecting straps 110 to infant support panel 102. At an end of left-side under leg strap 108 opposite of infant support panel 102 is left-side clip 112. Right-side leg attachment member 104 preferably comprises a right-side under leg strap 114 which is preferably connected by a plurality of connecting straps 110 to infant support panel 102. At an end of right-side under leg strap 114 opposite of infant support panel 102 is right-side clip 116. An extra length 118 of the material comprising right-side under leg strap 114 is preferably fed through right-side clip 116. The length of right-side under leg strap 114 is preferably adjustable by a user by shortening or lengthening extra length 118. Left-side under leg strap 108, right-side under leg strap 114 and connecting straps 110 are all preferably constructed from a strong, flexible material such as nylon webbing.

Left-side clip 112 and right-side clip 116 are configured to engage one another so that left-side leg attachment member 104 and right-side leg attachment member 106 may be selectively connected to or disconnected from one another around legs of a caregiver. Alternative to the use of clips, left-side leg attachment member 104 and right-side leg attachment member 106 may be selectively connected by use of latches, hooks, magnets, hook and loop fasters, and the like. Further, many of the left-side and right-side constituents described may be reversed without affecting the function of the device.

Figure 2:
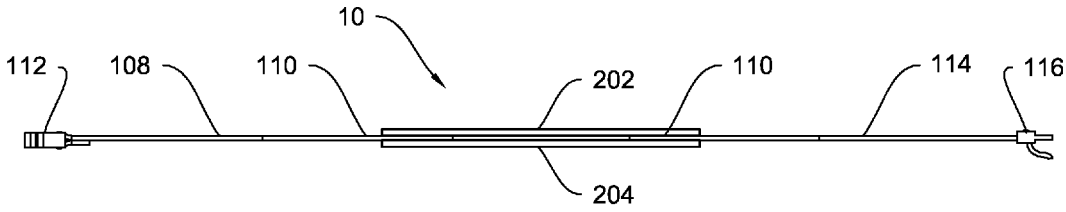
FIG. 2 is a bottom view of an infant lap support

Referring to FIG. 2, a side view shows the preferred multilayer construction of infant support panel 102. Infant support panel 102 preferably comprises an infant support layer 202 and an underside layer 204. Infant support layer 202 and underside layer 204 are preferably constructed from a soft fabric which is preferably also elastic, such as spandex. However, other materials may be used, particularly other soft fabrics. Connecting straps 110 preferably extend between a portion of infant support layer 202 and underside layer 204. Connecting straps 110 are preferably attached to infant support layer 202 or underside layer 204 or both by sewing. Infant support layer 202 and underside layer 204 are also preferably attached to one another by sewing. Alternatively, infant support layer 202 and underside layer 204 could be removably attached to one another, by hook and loop fastener, for example. As a further alternative, infant support panel 102 could be constructed using only one layer.

Figure 3:
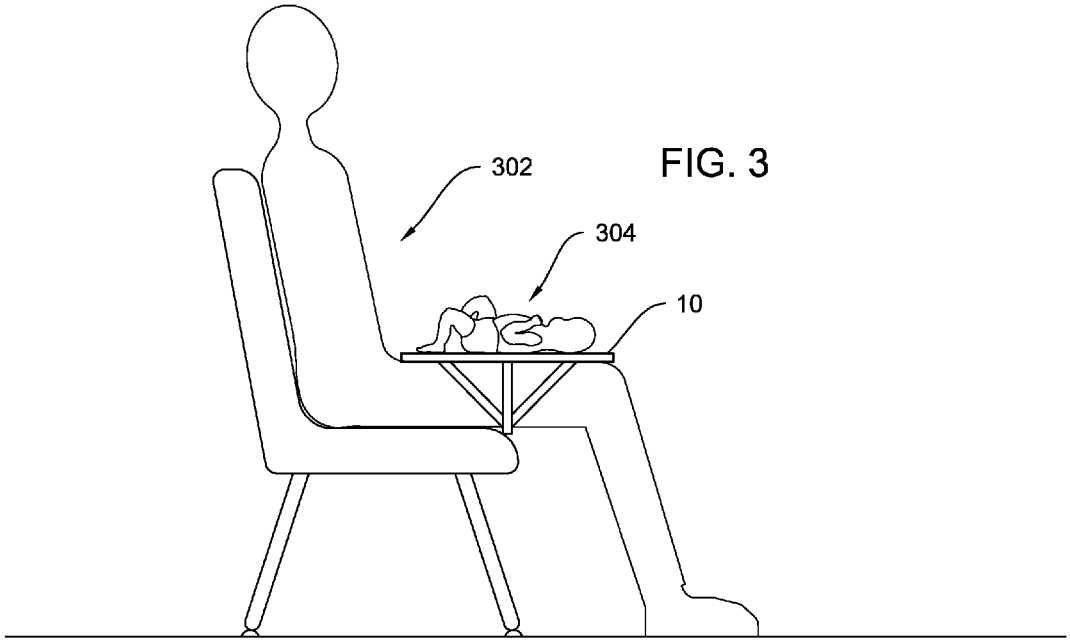
FIG. 3 is a side view of an infant lap support shown attached to a user and supporting an infant.

FIG. 3 shows infant lap support 10 attached to a user 302 and supporting an infant 304.

Figure 4:
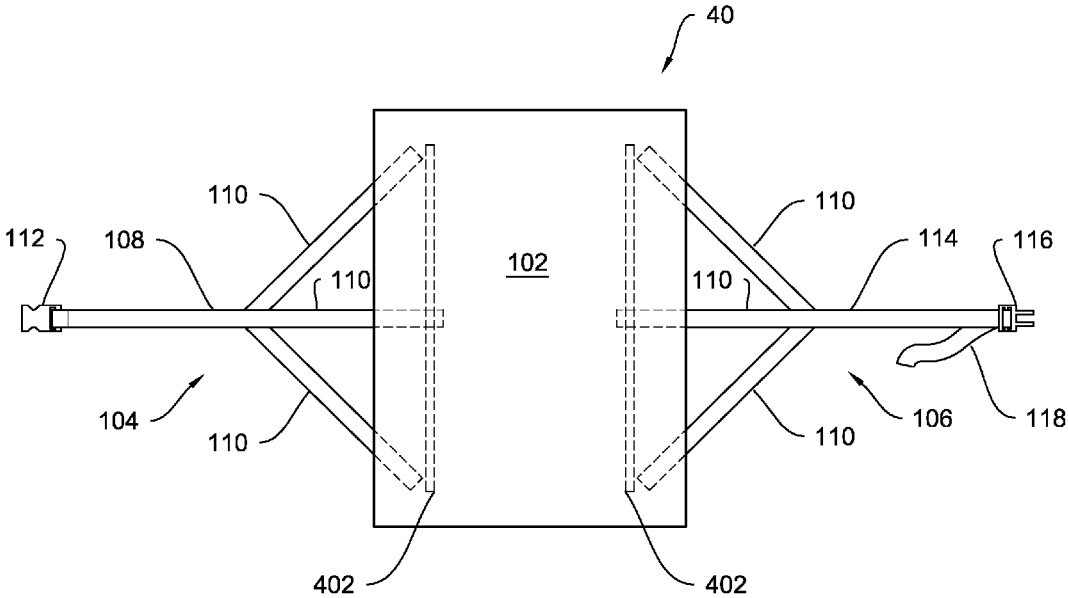
FIG. 4 shows an alternative embodiment of an infant lap support.

FIG. 4 shows an alternative embodiment of an infant lap support 40. In this embodiment, infant support panel 102 includes reinforcing members 402. Reinforcing members 402 are preferably rigid or semi rigid, long, thin bars which extend longitudinally along at least part of infant support panel 102 and are preferably secured to or within infant support panel 102, such as by placing reinforcing members 402 in pockets sewn into infant support panel 102. Reinforcing members 402 help maintain longitudinal support for the infant's head, spine and legs. Reinforcing members 402 are preferably positioned parallel to one another, at or near horizontally opposing edges of infant support panel 102 and outside of a middle portion of infant support panel 102 on which infant 304 is expected to rest.

Figure 5:
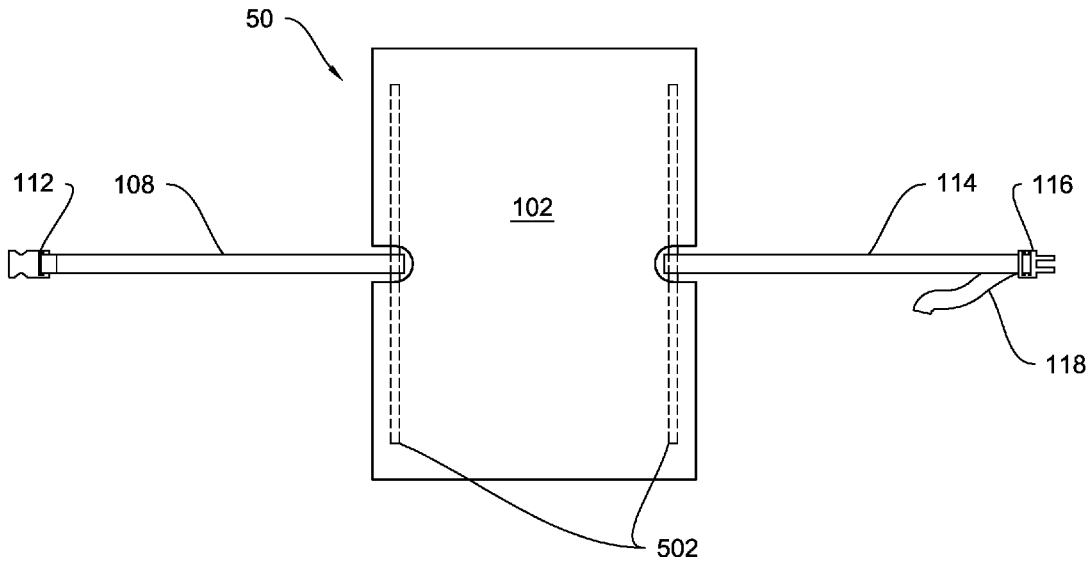
FIG. 5 shows a further alternative embodiment of an infant lap support.

FIG. 5 shows a further alternative embodiment of an infant lap support 50. Infant lap support 50 includes reinforcing members 502. Reinforcing members 502 in infant lap support 50 are preferably rigid, as left-side under leg strap 108 and right-side under leg strap 114 connect directly to reinforcing members 502, rather than connecting to infant support panel 102 by connecting members 110. Further, reinforcing members 502 in infant lap support 50 are preferably located at or near extreme edges of infant support panel 102.

Figure 6:
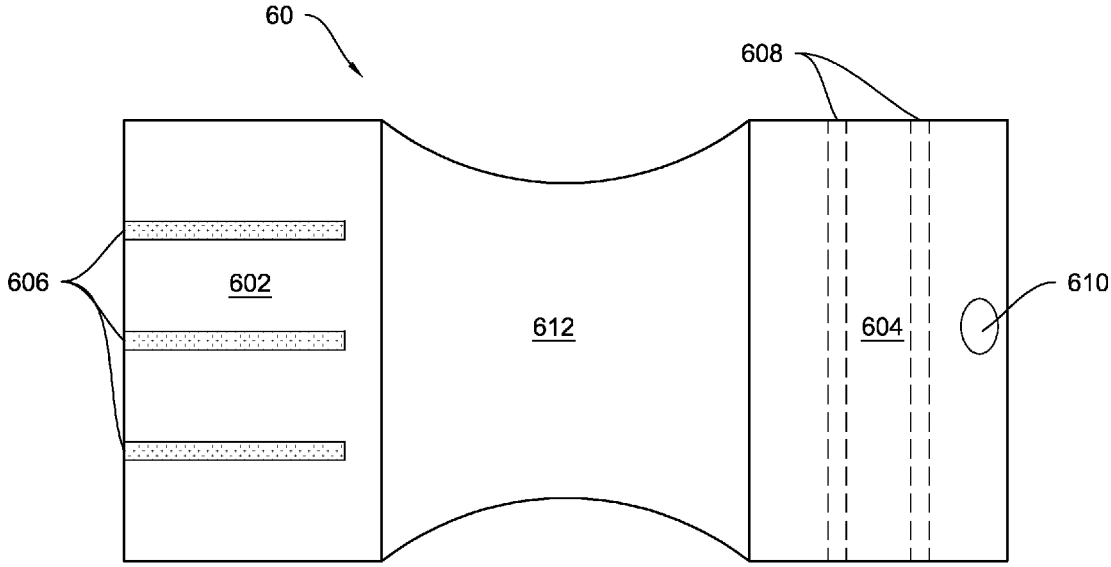
FIG. 6 shows an additional alternative embodiment of an infant lap support.

FIG. 6 shows an additional alternative embodiment of an infant lap support 60. Infant lap support 60 comprises an infant support panel 604, which comprises one or more first engagement members 608 affixed to the underside of infant support panel 604 (i.e. the face of infant support panel 604 opposite of the face upon which an infant will rest). First engagement members 608 preferably comprise a loop portion of a hook and loop fastener arranged in vertical strips.

Infant support member 60 also comprises a leg engagement panel 612 attached to an edge of infant support panel 604. Leg engagement panel 612 is preferably constructed from an elastic fabric. Leg engagement panel 612 is also preferably attached at its edge opposite infant support panel 604 to an edge of attachment panel 602. Attachment panel 602 preferably has the same vertical length as infant support panel 604. Leg engagement panel 612 preferably has the same vertical length as infant support panel 604 and attachment panel 602 on the edges of leg engagement panel 612 that are attached to infant support panel 604 and attachment panel 602, but preferably slopes between the attached edges so that leg engagement panel 612 is narrower in at least a portion of the space between its attached edges.

Attachment panel 602 preferably comprises one or more second engagement members 606. Second engagement members 606 preferably comprise the hook portion of a hook and loop fastener. Second engagement members 606 are preferably arranged as horizontal strips and are configured to engage first engagement members 608 when infant lap support 60 is wrapped around legs of a caregiver.

Figure 7:
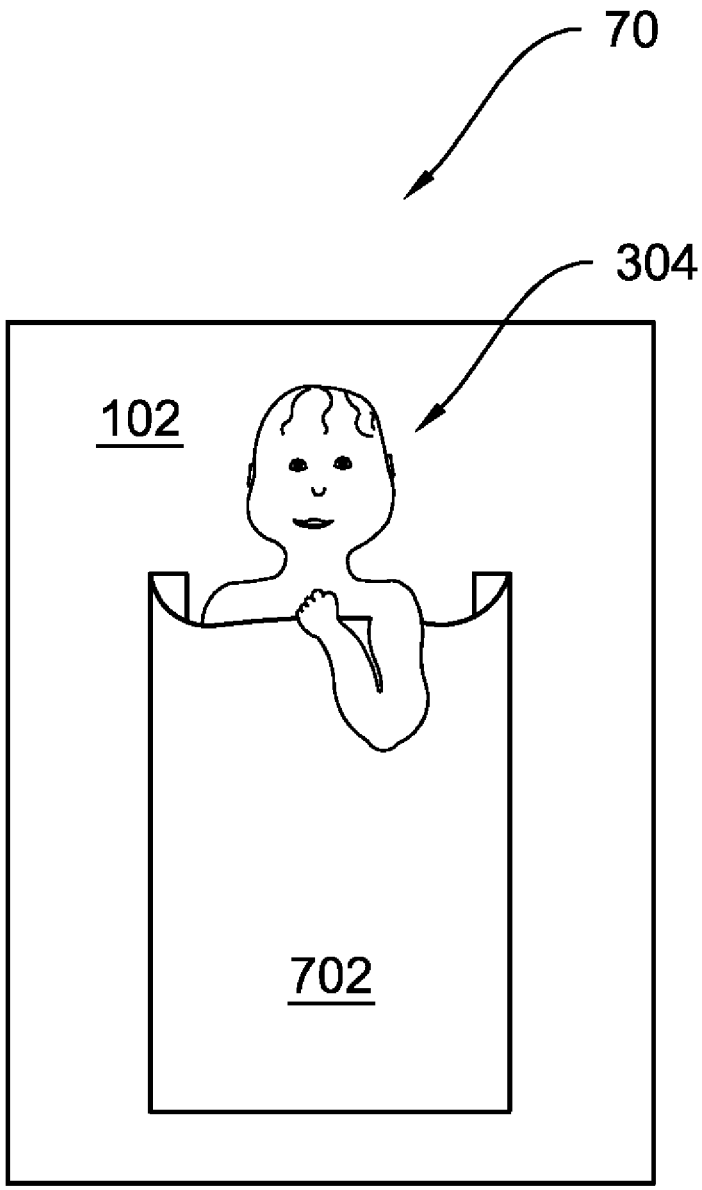
FIG. 7 shows an embodiment of a infant support panel that may be used in connection with an infant lap support.
Figure 8:
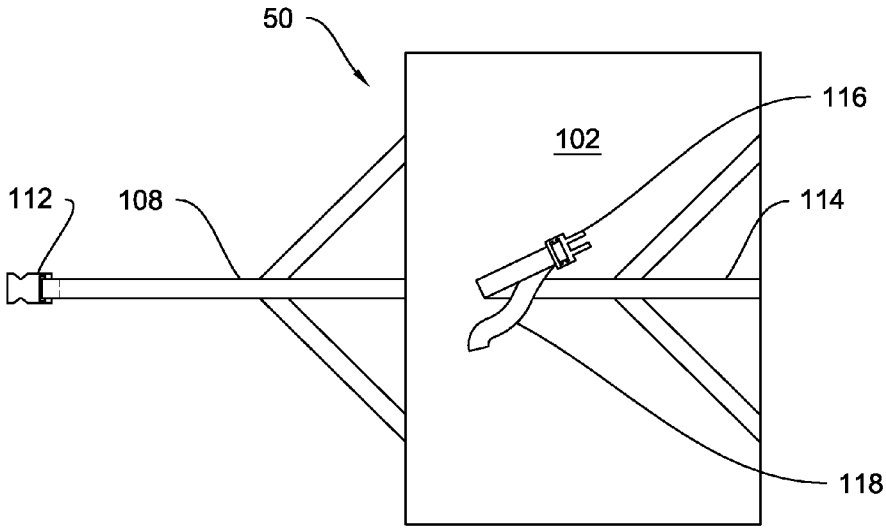
FIGS. 8-17 show an example embodiment of a foldable infant lap support.
Figure 9:
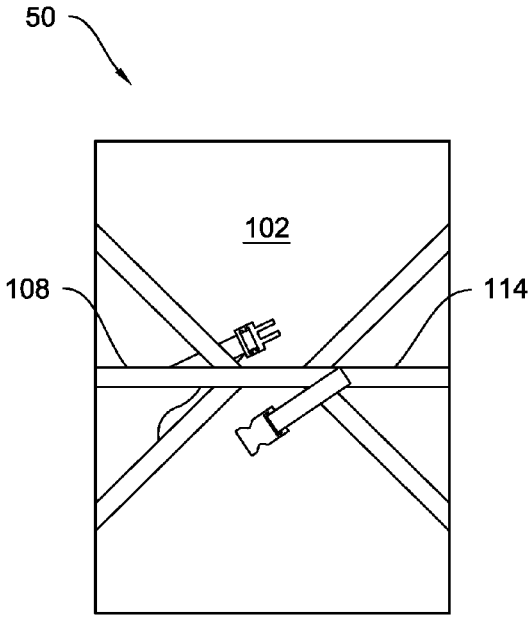
Figure 10:
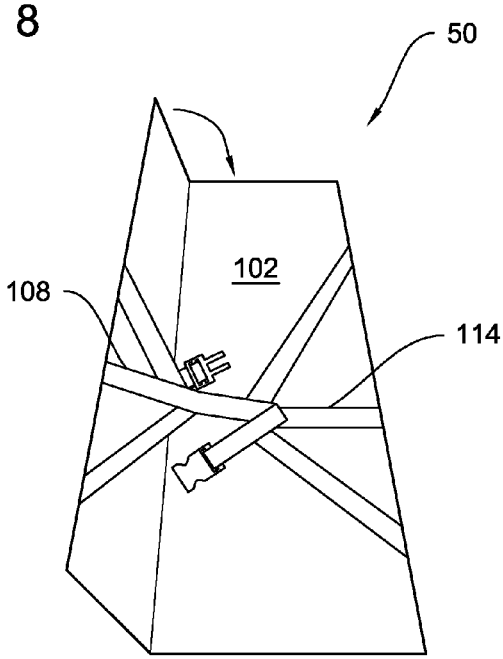
Figure 11:
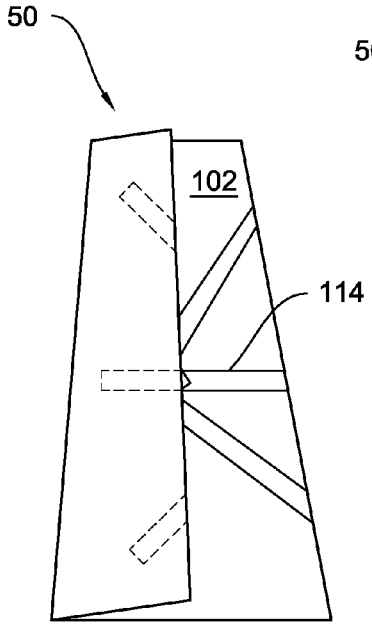
Figure 12:
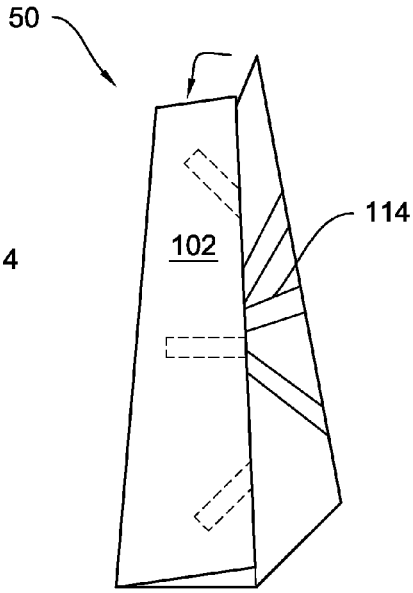
Figure 13:
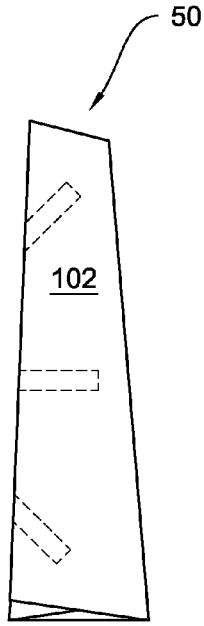
Figure 14:
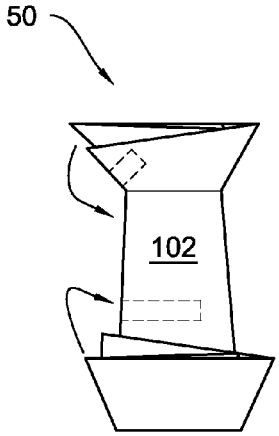
Figure 15:
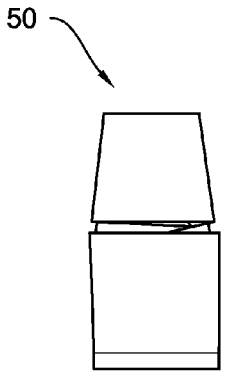
Figure 16:
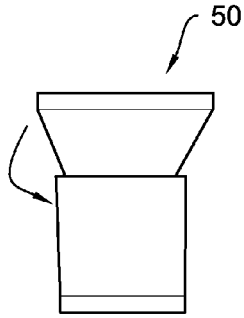
Figure 17:
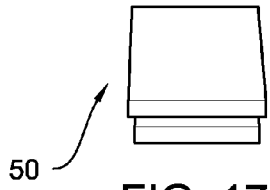
Figure 18:
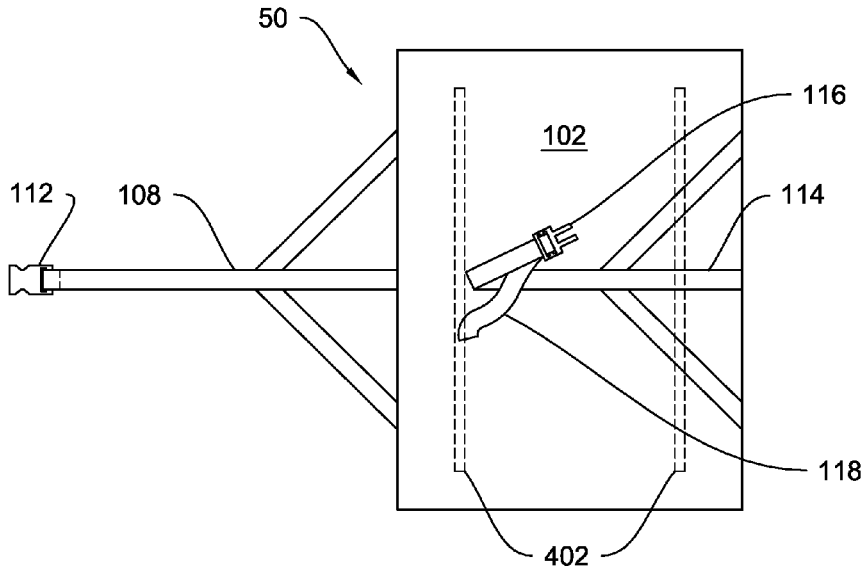
FIGS. 18-21 show an example embodiment of a rollable infant lap support.
Figure 19:
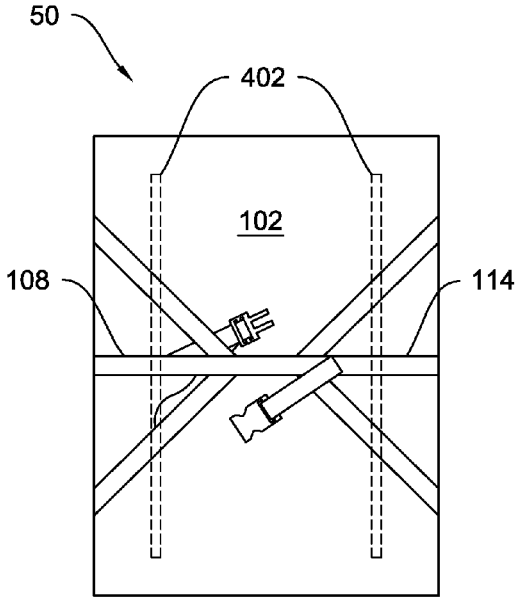
Figure 20:
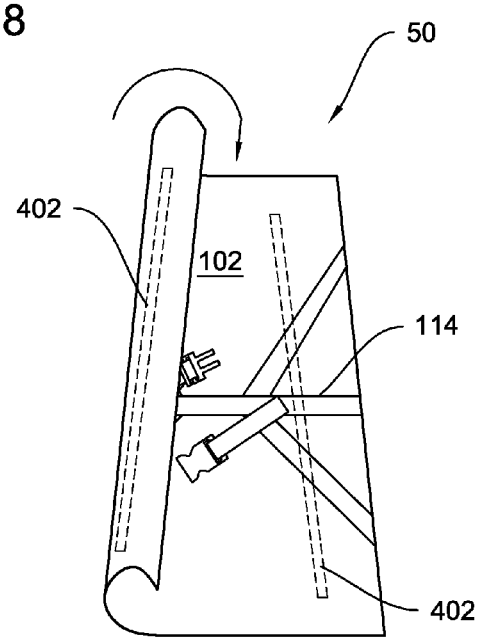
Figure 21:
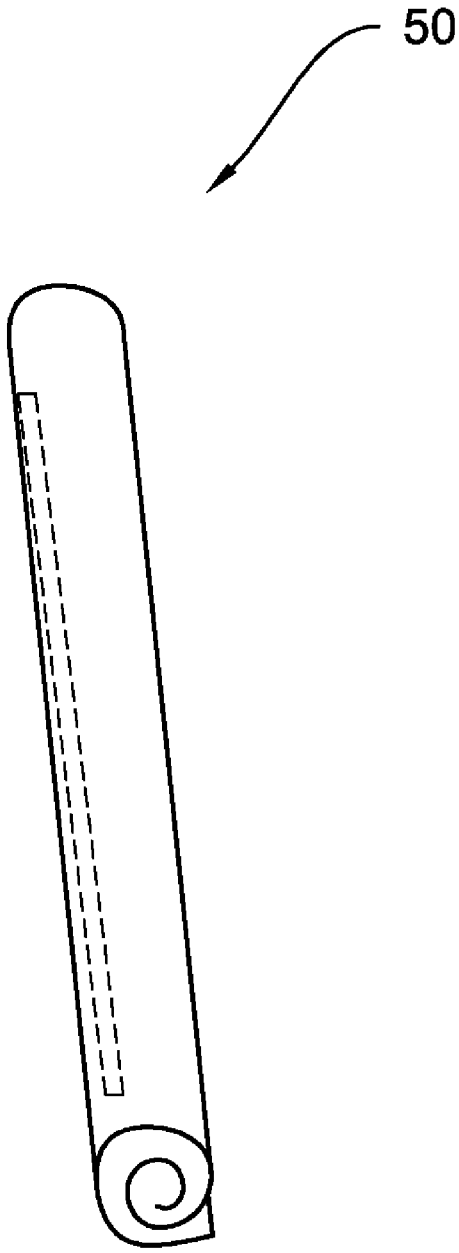

FIG. 7 shows an alternative embodiment of an infant support panel 70 which may be used in place of infant support panel 102 in any of the afore described embodiments of an infant lap support. Infant support panel 70 includes an infant restraint 702, in which an infant 304 may be placed while being supported on infant support panel 70. Infant restraint 702 is preferably a piece of fabric sewn onto infant support panel 70 for form a pouch. The fabric used to create infant restrain 702 is preferably a soft fabric that provides a comfortable environment for infant 304 whether infant 304 is placed under or on top of infant restraint 702. Infant restraint 702 preferably extends a vertical distance up infant support panel 70 which is less than the length of infant 304. Infant restraint 702 provides warmth for infant 304 and protects infant 304 from falling from infant support panel 70 when not being restrained by caregiver 302. To prevent suffocation, the pouch of infant restraint 702 preferably comprises a wide opening at the end closer to the head of infant 304 and is preferably made of a breathable fabric. Alternative to a pouch, infant restrain 702 may comprise two or more straps which are attached to infant support panel 70 at one end above the shoulders of infant 304 on opposite sides of infant 304's head, and which cross over the chest of infant 304 and are attached at their opposing end to infant support panel 70 at a point below or adjacent to infant 304's chest. Further alternatively, infant restraint 702 may comprise a strap, attachable wings, or the like.

All of the embodiments of an infant lap support described above are preferably constructed so that they may be easily rolled or folded by hand into a small package, such as a cylinder, rectangle, or other shape with a volume of less than 0.1 cubic meters, more preferably less than 0.05 cubic meters and most preferably less than 0.025 cubic meters.

Although the invention has been described with reference to specific embodiments, this description is not meant to be construed in a limiting sense. Various modifications of the disclosed embodiments, as well as alternative embodiments of the inventions, will become apparent to persons skilled in the art upon reference to the description of the invention. It is, therefore, contemplated that the appended claims will cover such modifications that fall within the scope of the invention.

I claim:

1. An infant lap support comprising:

an infant support panel having a first edge and a second edge, wherein at least a portion of the infant support panel comprises a soft and flexible material;

a leg attachment member having two or more attachment points, wherein a first attachment point is attached to the first edge of the infant support panel and wherein a second attachment point is attached to a first fastener;

a second fastener attached to the second edge of the infant support panel, wherein the first fastener and the second fastener are configured to be selectively fastened to each other around the legs of a user; and wherein the infant lap support is constructed and dimensioned so that the infant lap support can be rolled or folded by hand into a cylinder, rectangle, or other shape with a volume of less than 0.1 cubic meters.

2. The infant lap support of claim 1 wherein the second fastener is attached to the infant support panel by way of a second leg attachment member, the second leg attachment member having two or more attachment points, wherein a first attachment point of the second leg attachment member is attached to the second edge of the infant support panel and a second attachment point of the second leg attachment member is attached to the second fastener.

3. The infant lap support of claim 1 wherein the first and second fasteners comprise two halves of a latch, buckle, button fastener, snap, magnetic fastener, or hook and loop fastener.

4. The infant lap support of claim 1 wherein the infant support surface is generally rectangular.

5. The infant lap support of claim 1 wherein the first edge and the second edge of the infant support panel are opposite of each other.

6. The infant lap support of claim 1 wherein the infant lap support is constructed and dimensioned so that the infant support panel can be rolled or folded by hand into a cylinder, rectangle, or other shape with a volume of less than 0.025 cubic meters.

7. The infant lap support of claim 1 wherein the leg attachment member is attached to the infant support panel by two or more connecting members, which attach to the first edge of the infant support panel at two or more locations.

8. The infant lap support of claim 7 wherein the infant support panel comprises a first layer and a second layer, and wherein the connecting members extend across a portion of the infant support panel between the first layer and the second layer.

9. An infant lap support comprising:

an infant support panel having a first edge and a second edge, wherein at least a portion of the infant support panel comprises a soft and flexible material;

a leg attachment member having two or more attachment points, wherein a first attachment point is attached to the first edge of the infant support panel and wherein a second attachment point is attached to a first fastener;

a second fastener attached to the second edge of the infant support panel, wherein the first fastener and the second fastener are configured to be selectively fastened to each other around the legs of a user;

wherein the leg attachment member is attached to the infant support panel by two or more connecting members, which attach to the first edge of the infant support panel at two or more locations;

wherein the infant support panel comprises a first layer and a second layer, and wherein the connecting members extend across a portion of the infant support panel between the first layer and the second layer and the first and second layer of the infant support panel and the connecting members are sewn together.

10. The infant lap support of claim 1 wherein the infant support panel comprises two or more reinforcing members configured to provide vertical rigidity to the infant support panel, wherein a first reinforcing member is located along or near the first edge of the infant support panel and a second reinforcing member is located along or near the second edge of the infant support panel.

11. The infant lap support of claim 1 wherein the infant support panel comprises an infant restraint configured to hinder an infant from moving off of the infant support panel.

12. The infant lap support of claim 1 wherein the leg attachment member has a length which is adjustable by a user.

13. An infant lap support comprising:

an infant support panel, wherein the infant support panel comprises first and second vertical edges which are generally straight and which are horizontally opposed;

a first reinforcing member attached to the first vertical edge;

a second reinforcing member attached to the second vertical edge;

a first leg attachment member with two attachment points, wherein the first attachment point is attached to the first reinforcing member and the second attachment point is attached to a first fastener;

a second leg attachment member with two attachment points, wherein the first attachment point is attached to the second reinforcing member and the second attachment point is attached to a second fastener;

wherein the first and second fasteners are configured to be selectively connected by a user around legs of the user; and wherein the infant lap support is constructed and dimensioned so that said infant lap support can be rolled or folded by hand into a cylinder, rectangle, or other shape with a volume of less than 0.1 cubic meters.

14. The infant lap support of claim 13 wherein the infant lap support is constructed and dimensioned so that the infant support panel can be rolled or folded by hand into a cylinder, rectangle, or other shape with a volume of less than 0.025 cubic meters.

15. The infant lap support of claim 13 wherein the infant support panel comprises an infant restraint configured to hinder an infant from moving off of the infant support panel.

16. The infant lap support of claim 13 wherein the first or second fastener has a length that is adjustable by a user.

17. An infant lap support comprising:

an infant support panel, the infant support panel comprising an edge and first and second opposing faces, the first face of the infant support panel being configured to support an infant and the second face of the infant support panel comprising at least a portion of hook and loop fastener;

a leg engagement panel comprising first and second edges, wherein the first edge is attached to the edge of the infant support panel;

a fastening panel comprising an edge, the fastening panel being attached at the edge to the second edge of the leg engagement panel, wherein the fastening panel further comprises a portion of a hook and loop fastener;

wherein the portion of hook and loop fastener on the fastening panel is configured to selectively engage the portion of hook and loop fastener on the infant support panel when the infant lap support is connected around legs of a user; and wherein the infant lap support is constructed and dimensioned so that said infant lap support can be rolled or folded by hand into a cylinder, rectangle, or other shape with a volume of less than 0.1 cubic meters.

18. The infant lap support of claim 17 wherein the infant lap support is constructed and dimensioned so that the infant support panel can be rolled or folded by hand into a cylinder, rectangle, or other shape with a volume of less than 0.025 cubic meters.

19. The infant lap support of claim 17 wherein the infant support panel comprises an infant restraint configured to hinder an infant from moving off of the infant support panel.

20. The infant lap support of claim 17 wherein the infant support panel comprises two or more reinforcing members configured to provide vertical rigidity to the infant support panel, wherein a first reinforcing member is located along or near the edge of the infant support panel and a second reinforcing member is located along or near a second edge of the infant support panel.

* * * * *